US010079429B1

(12) United States Patent
Kerselaers et al.

(10) Patent No.: US 10,079,429 B1
(45) Date of Patent: Sep. 18, 2018

(54) WIRELESS DEVICE ANTENNA

(71) Applicant: NXP B.V., Eindhoven (NL)

(72) Inventors: Anthony Kerselaers, Herselt (BE); Liesbeth Gommé, Anderlecht (BE)

(73) Assignee: NXP B.V., Eindhoven (NL)

( * ) Notice: Subject to any disclaimer, the term of this patent is extended or adjusted under 35 U.S.C. 154(b) by 72 days.

(21) Appl. No.: 15/453,538

(22) Filed: Mar. 8, 2017

(51) Int. Cl.

| | |
|---|---|
| ***H01Q 1/36*** | (2006.01) |
| ***H01Q 1/27*** | (2006.01) |
| ***H01Q 1/50*** | (2006.01) |
| ***H01Q 7/00*** | (2006.01) |

(52) U.S. Cl.
CPC ..... *H01Q 1/36* (2013.01); *H01Q 1/273* (2013.01); *H01Q 1/50* (2013.01); *H01Q 7/00* (2013.01)

(58) Field of Classification Search
CPC ..... H01Q 1/36; H01Q 1/273; H01Q 1/50; H01Q 7/00
See application file for complete search history.

(56) References Cited

U.S. PATENT DOCUMENTS

| | | | | |
|---|---|---|---|---|
| 7,859,469 | B1 | 12/2010 | Rosener et al. | |
| 9,402,120 | B2 | 7/2016 | Linden et al. | |
| 2004/0212542 | A1* | 10/2004 | Rahim | G06K 7/10336 343/742 |
| 2009/0231211 | A1 | 9/2009 | Zweers | |
| 2011/0195661 | A1* | 8/2011 | Miyashita | H01Q 1/242 455/39 |
| 2016/0050501 | A1 | 2/2016 | Pinto | |
| 2016/0205461 | A1 | 7/2016 | Fernandez-Medina et al. | |
| 2017/0040701 | A1 | 2/2017 | Hanabusa | |

FOREIGN PATENT DOCUMENTS

| | | |
|---|---|---|
| DK | 201470487 A1 | 2/2016 |
| EP | 2 119 197 B1 | 7/2012 |
| EP | 2835862 A1 | 2/2015 |

* cited by examiner

*Primary Examiner* — Hoang Nguyen

(57) ABSTRACT

Antenna, including: a first conductive structure having a first end coupled to a conductive strip and a second end; wherein the conductive strip is coupled to a first feed point; a second conductive structure having a first portion and a second portion; wherein the second portion is coupled to a second feed point; wherein the second end of the first conductive structure is separated from the first portion of the second conductive structure by a gap; wherein the first conductive structure is substantially in parallel with and has a different width than the first portion of the second conductive structure; wherein the first conductive structure is configured to carry current in a first polarity and the first portion of the second conductive structure is configured to carry current in a second polarity opposite to the first polarity; and wherein the feed points are configured to carry an RF signal.

18 Claims, 9 Drawing Sheets

WIRELESS DEVICE ANTENNA

The present specification relates to systems, methods, apparatuses, devices, articles of manufacture and instructions for a wireless antenna.

SUMMARY

According to an example embodiment, an antenna, comprising: a first conductive structure having a first end coupled to a conductive strip and a second end; wherein the conductive strip is coupled to a first feed point; a second conductive structure having a first portion and a second portion; wherein the second portion is coupled to a second feed point; wherein the second end of the first conductive structure is separated from the first portion of the second conductive structure by a gap; wherein the first conductive structure is substantially in parallel with and has a different width than the first portion of the second conductive structure; wherein the first conductive structure is configured to carry current in a first polarity and the first portion of the second conductive structure is configured to carry current in a second polarity opposite to the first polarity; and wherein the first and second feed points are configured to carry an RF signal.

In another example embodiment, the first conductive structure is configured to have a first current density; the first portion of the second conductive structure is configured to have a second current density; and the first current density is different from the second current density.

In another example embodiment, the first current density is greater than the second current density.

In another example embodiment, the conductive strip is substantially in parallel with and has a different width than the second portion of the second conductive structure; and the conductive strip is configured to carry current in a first polarity and the second portion of the second conductive structure is configured to carry current in a second polarity opposite to the first polarity.

In another example embodiment, the conductive strip is configured to have a first current density; the second portion of the second conductive structure is configured to have a second current density; and the first current density is different from the second current density.

In another example embodiment, the first current density is greater than the second current density.

In another example embodiment, a total electrical length of the first conductive structure, the conductive strip, and the second conductive structure is at least ½ wavelength of the frequency received at the first and second feed points.

In another example embodiment, an electrical length of the first conductive structure added to an electrical length of the conductive strip is at least ¼ wavelength of the frequency received at the first and second feed points.

In another example embodiment, the first conductive structure and the first portion of the second conductive structure are configured to radiate a transverse RF signal; and the conductive strip and the second portion of the second conductive structure are configured to radiate a surface RF signal.

In another example embodiment, the first portion of the second conductive structure is substantially perpendicular to the second portion of the second conductive structure.

In another example embodiment, the second conductive structure is a battery, the first portion is a top of the battery and the second portion is a side of the battery.

In another example embodiment, a distance between the first conductive structure and the first portion of the second conductive structure is less than quarter wavelength.

In another example embodiment, the first conductive structure has at least one of: a circular shape, a rectangular shape, or a spiral shape.

In another example embodiment, the antenna is embedded in at least one of: a wireless device, a wearable device, a hearing aid, an earbud, a smart watch, an audio device, or a wireless road traffic device.

In another example embodiment, further comprising a first substrate and a second substrate; wherein the first conductive structure is separated by the first substrate from the first portion of the second conductive structure; wherein the second substrate is parallel to the second portion of the second conductive structure; and wherein the second substrate includes at least one of: a PC board, electronic components or an RF circuit.

In another example embodiment, further comprising a conducting plane; wherein the conducting plane is parallel to the second substrate; and wherein the second feed point is coupled to the conducting plane.

In another example embodiment, the conducting plane is coupled to a negative potential of an electronic circuit in the second substrate.

According to an example embodiment, a wearable device, comprising: an antenna, including, a first conductive structure having a first end coupled to a conductive strip and a second end; wherein the conductive strip is coupled to a first feed point; a second conductive structure having a first portion and a second portion; wherein the second portion is coupled to a second feed point; wherein the second end of the first conductive structure is separated from the first portion of the second conductive structure by a gap; wherein the first conductive structure is substantially in parallel with and has a different width than the first portion of the second conductive structure; wherein the first conductive structure is configured to carry current in a first polarity and the first portion of the second conductive structure is configured to carry current in a second polarity opposite to the first polarity; and wherein the first and second feed points are configured to carry an RF signal.

The above discussion is not intended to represent every example embodiment or every implementation within the scope of the current or future Claim sets. The Figures and Detailed Description that follow also exemplify various example embodiments.

Various example embodiments may be more completely understood in consideration of the following Detailed Description in connection with the accompanying Drawings, in which:

Figure 1A:
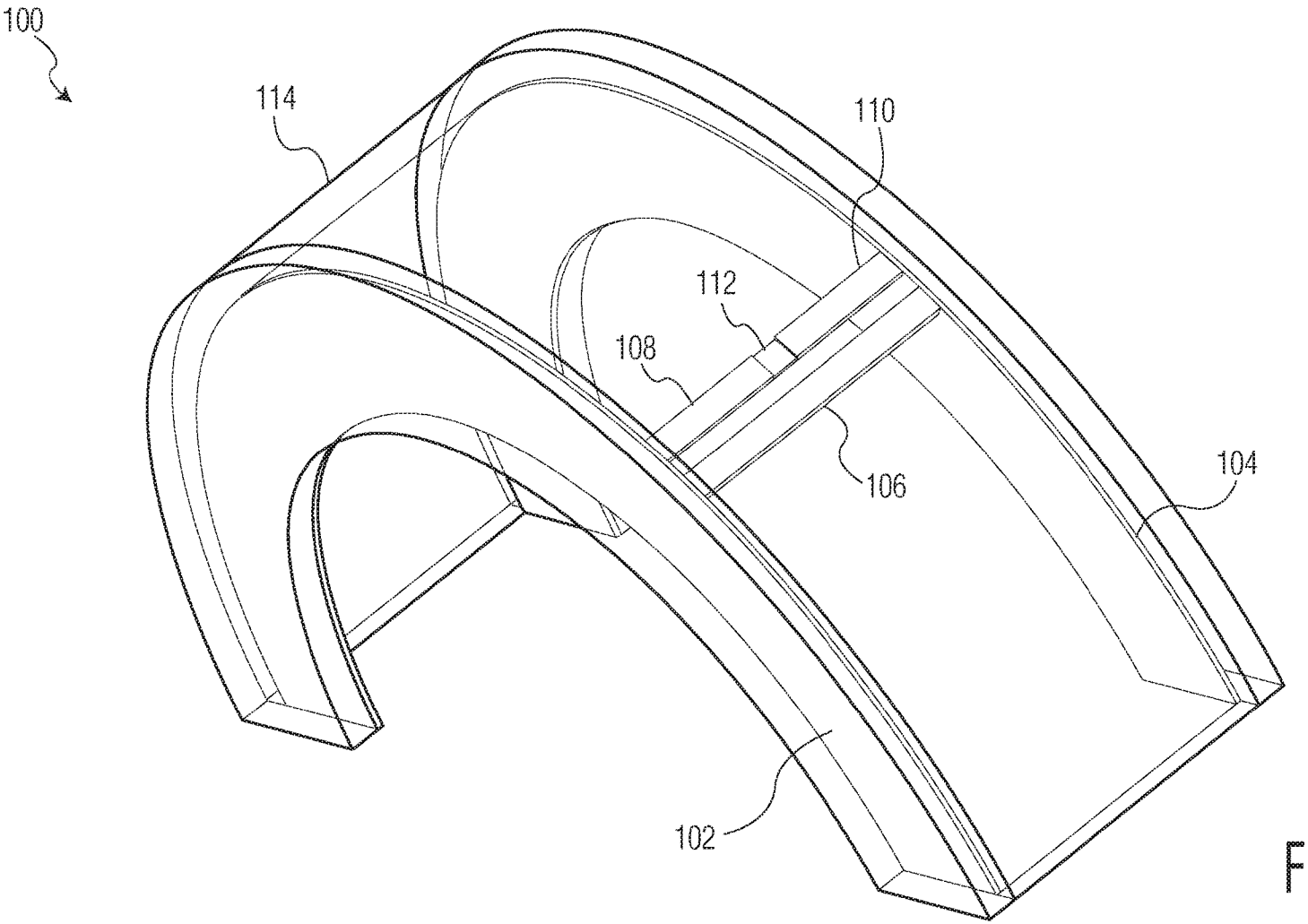
FIG. 1A is an example of a first wireless device antenna structure.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

DETAILED DESCRIPTION

Various wireless device form-factors, mobile or fixed, are getting smaller. For example, earbuds, hearing aids and smartphones are shrinking in size and increasing in functional capability, such as communications between two sets of earbud pairs on different users. Upcoming V2X (Vehicle-to-Everything) and IoT (Internet of Things) devices are also planned for dramatic increase.

The wireless device communications can be by means of analogue or digital modulation techniques and can contain data or audio information. In case of earbuds and hearing aids a combination of data and audio information can be communicated between the devices. The audio can be high quality audio, like CD quality or can be of lower quality speech. In the former case a higher bandwidth of the communication channel is required. Wearable devices can also be worn by a user that takes part of road traffic where the device is then able to communicate with other drivers, pedestrians, cars, bicycles, etc. according to various Car2X wireless communications standards.

Such devices preferably are able to communicate using different wireless standards (e.g. Bluetooth, WIFI or Cellular), but also using different propagation modes. For example, a first propagation mode (i.e. off-body mode) uses transversal waves that propagate over long distances, and a second propagation mode (i.e. on-body mode) uses surface waves [(i.e. creeping wave, ground wave, traveling wave, etc.) Surface waves are part of a class of electromagnetic waves that diffract around surfaces, such as a sphere, a building, a person, and so on.

In some example embodiments, both the on-body and off-body modes use RF frequencies to communicate (e.g. ISM band communication may use a 2.4 GHz carrier frequency, and Car2X which uses a 5.9 GHz carrier frequency for road traffic and vehicle communication).

Adding "on-body" and "off-body" communication to a wearable device is challenging due to the small form-factor of most wearable devices. For example an earbud can be as small as 15 mm, while the wavelength of a Bluetooth 2.5 GHz radio signal is 122 mm. Resonant antennas of a half wavelength (½ λ) electrical length (i.e. 61 mm in this example) will work with good efficiency. However such a 61 mm antenna may not reasonably fit into an earbud with a length of 15 mm. The antenna's electrical length can also be influenced by dielectric materials or nearby objects or folding of the conductive structure.

FIG. 1A is an example of a first wireless device antenna structure 100. The antenna 100 consists of a transmission line with two conducting surfaces 102, 104, lines 106, 108, 110, and a gap 112. Either end of the gap 112 becomes the feed points for the antenna 100 and are connected to another RF circuit (not shown). A non-conductive material 114 encases the antenna 100. In one example, the first antenna structure 100 is integrated into a hearing aid.

The conducting surfaces 102, 104 of the transmission line are opposite to each other and a distance between them can vary along their length. The length of conducting surfaces 102, 104 of the transmission line, together with the position and length of line 106 determines a resonance frequency of the antenna 100.

Lines 106, 108, 110 are the major radiating elements in this antenna 100. This is because the currents in conducting surfaces 102, 104 are opposite to each other, cancelling out their radiation. Currents in lines 106, 108, 110 are mainly going in the same direction and thereby generate far field radiation.

Conducting surfaces 102, 104 do affect the electrical length of the antenna 100 and enable the antenna 100 to resonate at half a wavelength of the carrier frequency (61 mm at 2.5 GHz). And mentioned above, such a 61 mm electrical length in this design can be a serious burden in small hearing aids or earbuds.

Figure 1B:
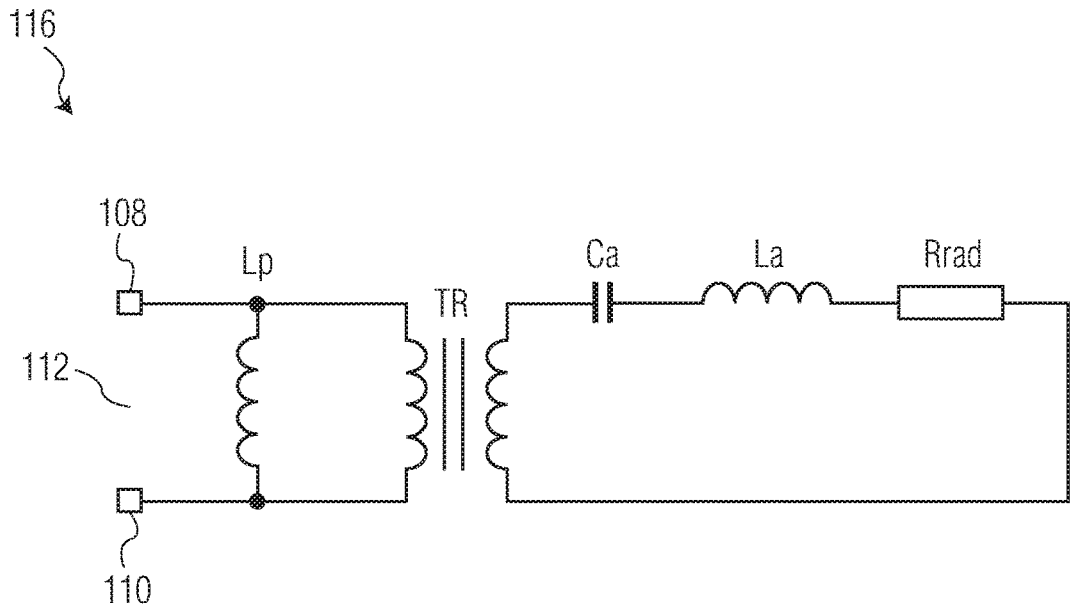
FIG. 1B is a first example circuit corresponding to the first wireless device antenna structure.

FIG. 1B is a first example circuit 116 corresponding to the first wireless device antenna structure 100. Resistance (Rrad) in one example is much lower than 50 ohms and is transformed by an ideal transformer (TR). In resonance reactance XCa=reactance XLa.

Figure 1C:
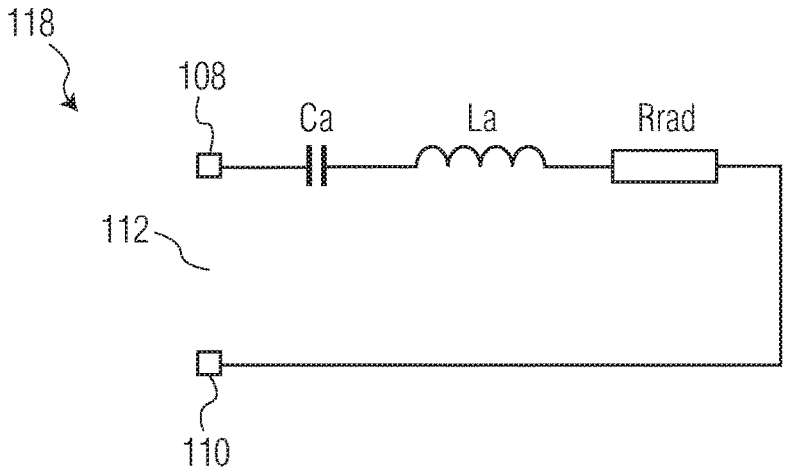
FIG. 1C is a second example circuit corresponding to the first wireless device antenna structure.

FIG. 1C is a second example circuit 118 corresponding to the first wireless device antenna structure 200. In this example, Rrad is set to 50 ohms or lower and then matched externally. As before, in resonance reactance XCa=reactance XLa.

Figure 2:
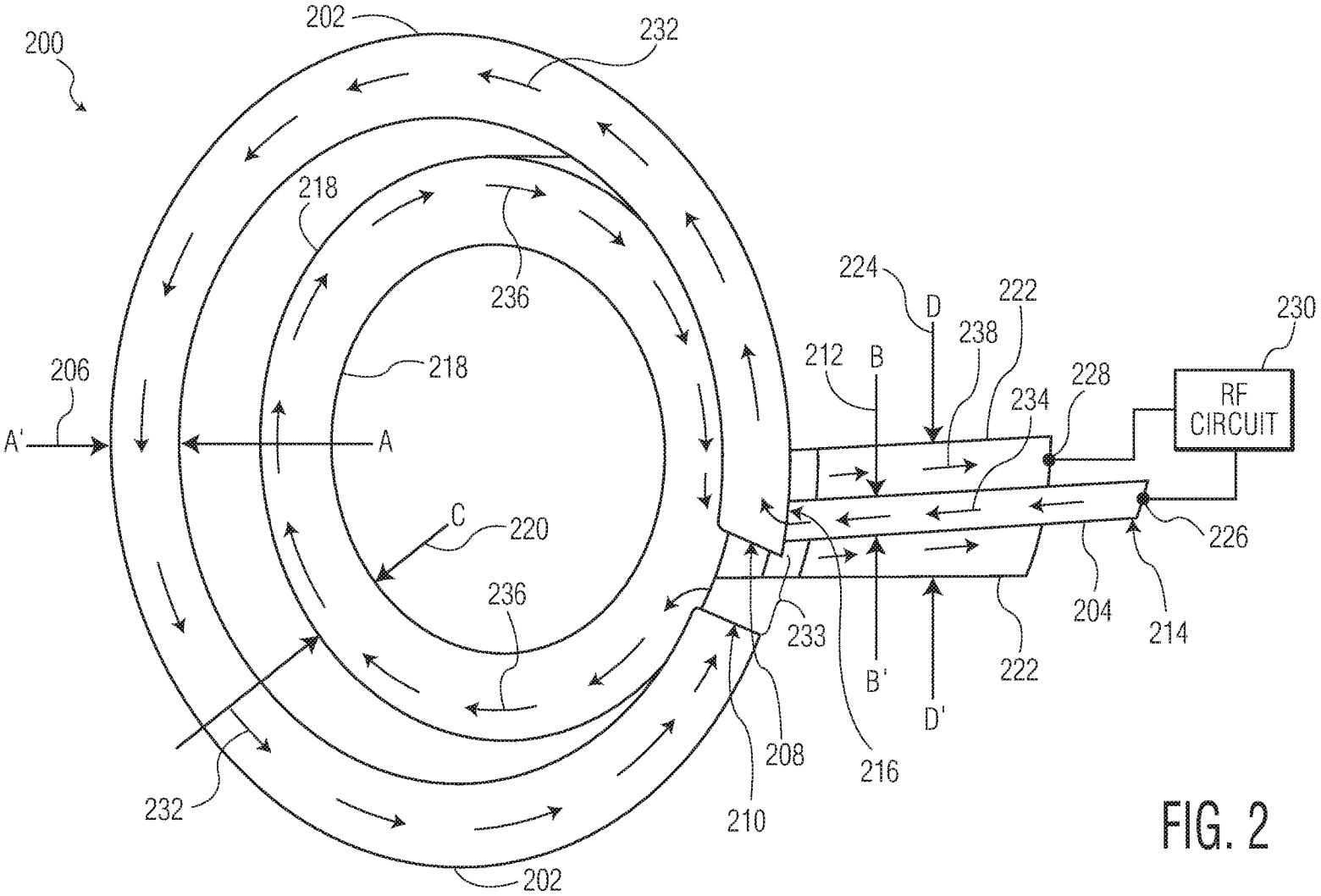
FIG. 2 is a first example of a second wireless device antenna structure.

FIG. 2 is a first example of a second wireless device antenna structure 200. The second wireless device antenna structure 200 includes a first conductive structure 202. The first conductive structure 202 includes a width 206 (e.g. A-A'), a first end 208, a second end 210 (open), a gap 233, and is configured to carry a current 232.

The antenna 200 also includes a conductive strip 204. The conductive strip 204 includes a width 212 (e.g. B-B'), a first end 214, a second end 216, and is configured to carry a current 234.

The antenna 200 includes a second conductive structure (not numbered) (e.g. B/Battery). The second conductive structure includes a first portion 218 having a width 220 (e.g. C-C') and configured to carry a current 236, and a second portion 222 having a width 224 (e.g. D-D') and configured to carry a current 238.

The antenna 200 further includes a first feed point 226 and a second feed point 228 for transmitting or receiving RF signals. These feed points 226, 228 are configured to be coupled to an RF circuit 230.

In one example, the RF circuit 230 is coupled to the antenna 200 to generate or receive an AC RF current signal which for ½ cycle flows as indicated by the arrows. The AC current flowing through the different structures, strips and portions of the antenna 200 are, for the purposes of this discussion, labeled as currents 232, 234, 236 and 238. The AC current is electrically coupled to the RF circuit 230 and, due to the physically parallel elements in the antenna 200, inductively coupled as well.

At a particular phase angle, the RF circuit 230 the current is at maximum amplitude at the first feed point 226 and the second feed point 228. Current 234 goes over the conductive strip 204 from the first end 214 to the second end 216 to the first end 208 of the first conductive structure 202. Current 232 follows the shape of the first conductive structure 202 to the second end 210.

In this ½ cycle example, the current amplitude decreases from the first feed point 226 at the RF circuit 230, until the second end 210 of the first conductive structure 202 where there is an open gap 233.

Due to the inductive effects of the parallel and proximate placement of the first conductive structure 202 with the first portion 218 of the second conductive structure, the polarity of current 236 in the first portion 218 of the second conductive structure is opposite to the polarity of current 232 in the first conductive structure 202.

At the intersection of the conductive strip 204 and the first conductive structure 202 (i.e. first end 208 and second end 216 intersection) current 236 is transitioning to current 238 in the second portion 222 of the second conductive structure.

In this ½ cycle example, the current amplitude then increases from the gap 233 along the first portion 218 of the second conductive structure until again reaching a maximum amplitude at the second feed point 228 on the second portion 222 of the second conductive structure.

The total antenna 200 structure thus has a total electrical length equal to ½ wavelength of the RF circuit's 230 RF operating frequency. ¼ of the wavelength is formed by the first conductive structure 202 and the conductive strip 204, and the other ¼ wavelength is formed by the first and second portions 218, 222 of the second conductive structure.

In one example, the current 236 density across the first portion 218 of the second conductive structure (e.g. over a battery) is lower (i.e. more distributed, more spread out, etc.) than the current 232 density through the first conductive structure 202, if the width 220 (e.g. C-C') is greater than the width 206 (e.g. A-A').

In another example, if the width 206 (e.g. A-A') is greater than the width 220 (e.g. C-C'), then the current 232 density would be more spread out than current 236 density.

This difference in current density, due to the different widths 206, 220, enables far-field RF transverse wave transmission with a polarization in a direction parallel to the planar surface of the first conductive structure 202 (e.g. parallel to a person's skin for the embodiment shown in FIGS. 7 and 8 discussed below if the person is wearing an earbud having an embedded antennal structure 200).

If the widths 206, 220 were the same, however, then the current 232 in the first conductive structure 202 and in the current 236 in the first portion 218 of the second conductive structure would tend to cancel out thus attenuating any transverse RF wave transmission.

Similarly in one example, the current 238 density across the second portion 222 of the second conductive structure is lower than the current 234 density through the conductive strip 204, if the width 224 (e.g. D-D') is greater than the width 212 (e.g. B-B').

In another example, if the width 212 (e.g. B-B') is greater than the width 224 (e.g. D-D'), then the current 234 density would be more spread out than current 238 density.

This unequal amount of current spreading due to the different widths 212, 224 enables far-field RF surface wave transmission with a polarization in a direction parallel to the planar surface of the conductive strip 204 (e.g. perpendicular to a person's skin for the embodiment shown in FIGS. 7 and 8 discussed below if the person is wearing an earbud having an embedded antennal structure 200).

Thus when the first conductive structure 202 and the conductive strip 204 are oriented perpendicular to each other (such as by surrounding a battery or other box-like structure), then two communications modes (e.g. "off-body" and "on-body") can be generated from the antenna structure 200.

The antenna's 200 resonance frequency can be adjusted by varying a total electrical length of the first conductive structure 202 and the conductive strip 204. Thus, in one example if the second conductive structure (i.e. 218 and 222 combined) is a battery, then an electrical length of the conductive strip 204 is defined by the battery's size; however, an electrical length of the first conductive structure 202 can still be adjusted, one example of which is in FIG. 3.

Figure 3:
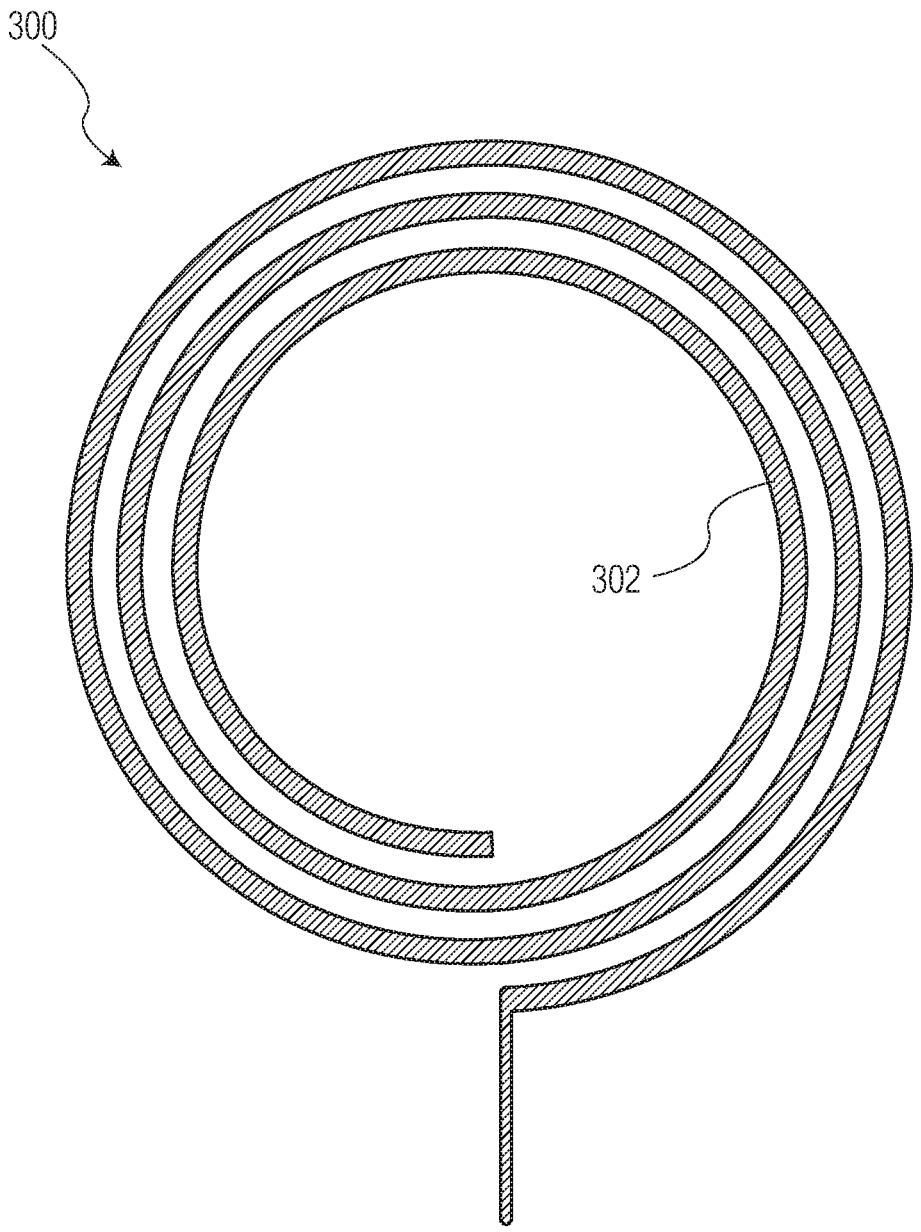
FIG. 3 is an alternate example for a first conductive structure in the second wireless device antenna structure.

FIG. 3 is an alternate example 300 for the first conductive structure 202 in the second wireless device antenna structure 200.

In this example 300 the shape of the first conductive structure 202 is a multi-turn ring 302 (e.g. spiral ring). This allows increasing the electrical length of the first conductive structure 202 even if dimensions of the second conductive structure (i.e. 218 and 222 combined) are fixed.

Figure 4:
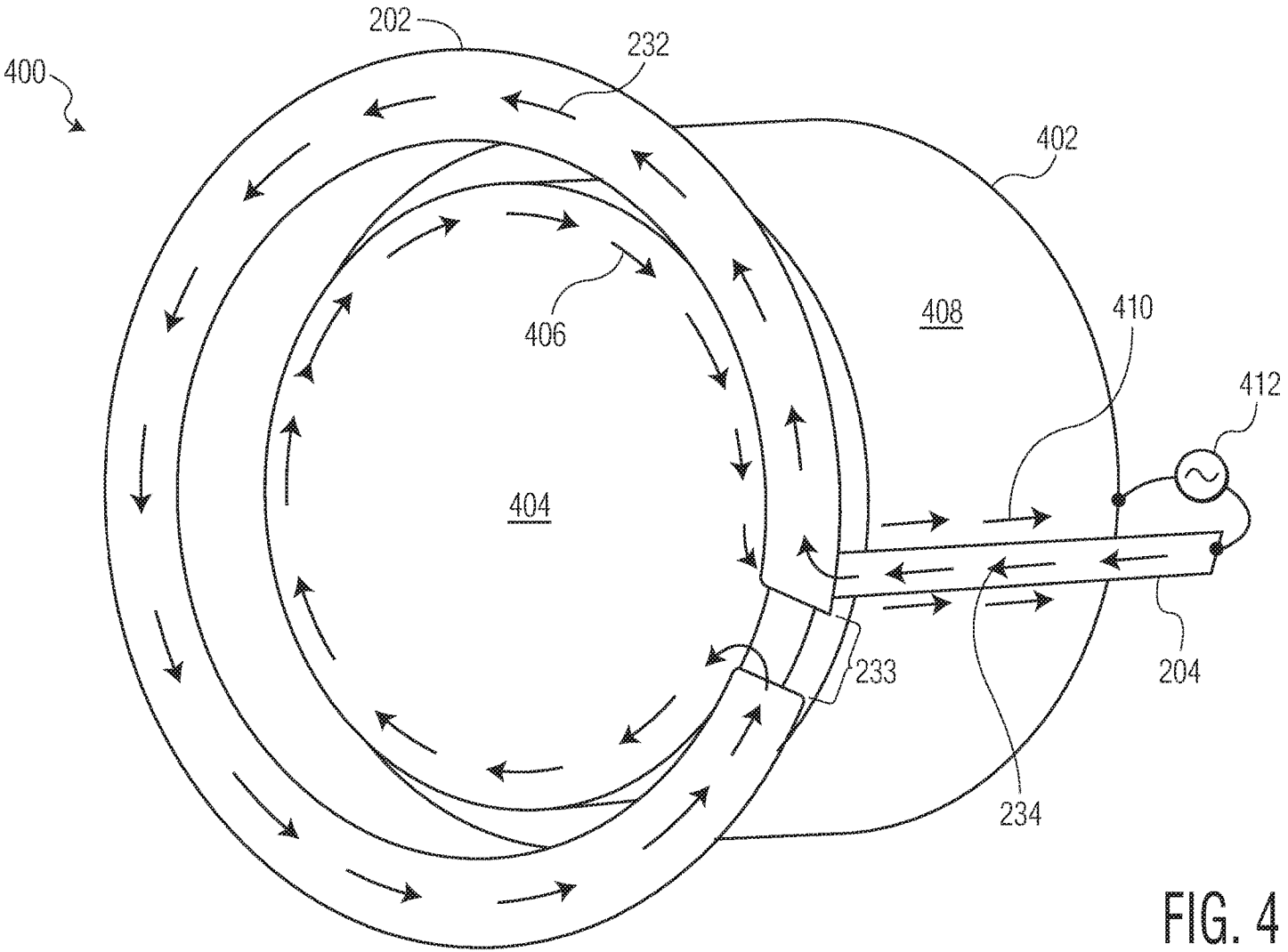
FIG. 4 is a second example of the second wireless device antenna structure.

FIG. 4 is a second example 400 of the second wireless device antenna structure 200. In this example 400, the second conductive structure (i.e. 218 and 222 combined) is a battery 402.

The battery 402 includes a first portion 404 which during interaction with RF circuit 412 carries current 406, and a second portion 408 which during interaction with the RF circuit 412 carries current 410.

The additional area of the first portion 404 on a top of the battery 402 permits a lower current 406 density than the current 232 in the first conductive structure 202. Thus transverse wave transmission, in one example, is greater than that shown in FIG. 2.

The additional area of the second portion 408 on a side of the battery 402 permits a lower current 410 density than the current 234 in the conductive strip 204. Thus surface wave transmission, in one example, is greater than that shown in FIG. 2.

Figure 5:
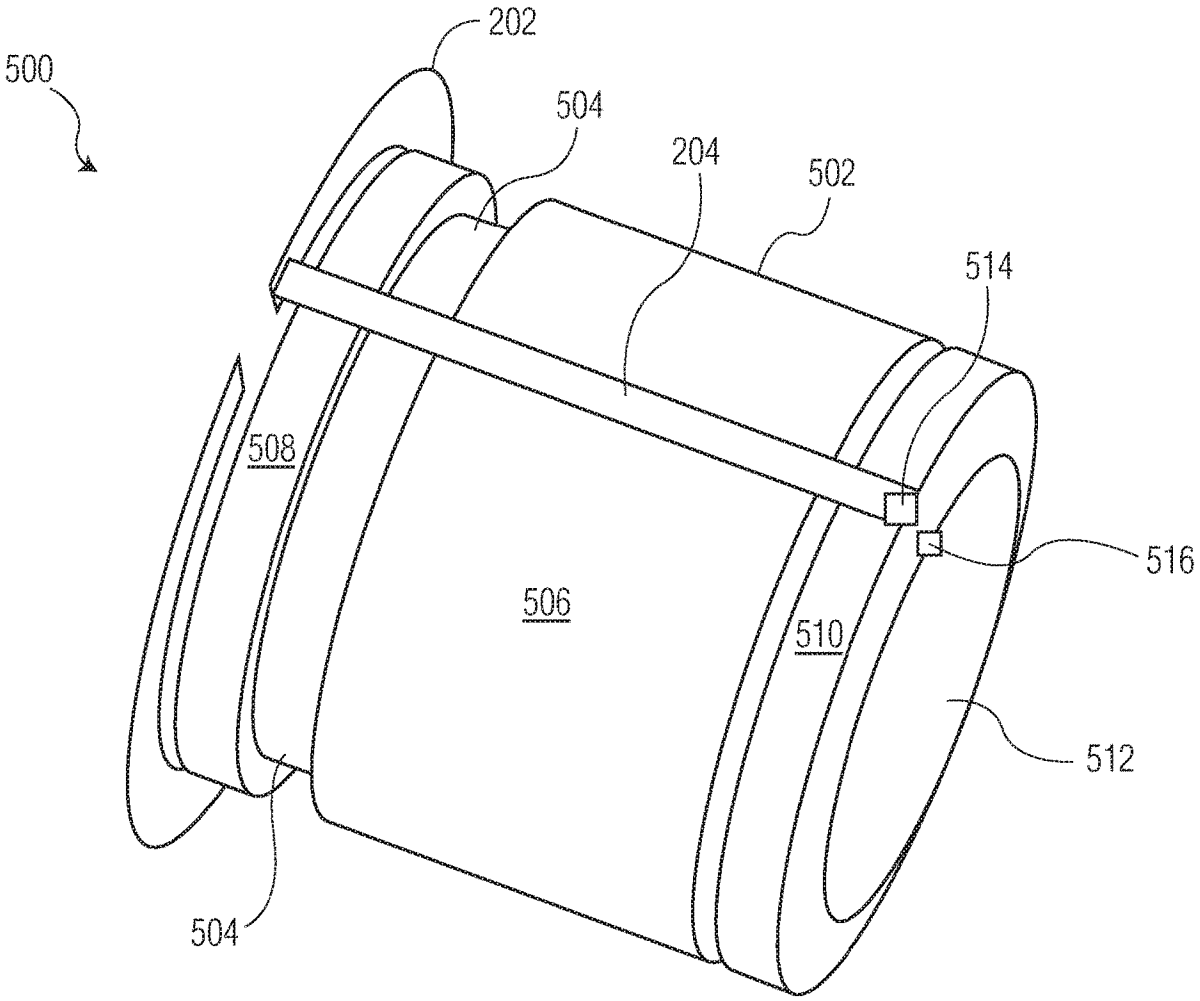
FIG. 5 is a third example of the second wireless device antenna structure.

FIG. 5 is a third example 500 of the second wireless device antenna structure 200. In this example 500, the second conductive structure (i.e. 218 and 222 combined) is also a battery 502. The battery 502 includes a first portion 504 and a second portion 506.

The first conductive structure 202 is separated by a first substrate 508 (e.g. printed circuit (PC) board) on top of the first portion 504 of the battery 502. A second substrate 510 (e.g. printed circuit (PC) board) is positioned next to the second portion 506 of the battery 502 as shown. Both substrates 508, 510 can be an FR4 material (i.e. a PCB material), air, or some other dielectric. The second substrate 510 can also include electronic components, such as an RF circuit and other supporting or interface antenna 200 components.

The first conductive structure 202 is positioned in parallel with the first portion 504 opposite the first substrate 508. The conductive strip 204 is galvanically connected with first conductive structure 202 and is parallel positioned with the battery 502.

In one example, a negative potential of electronic circuitry in the second substrate 510 is connected to a larger conducting plane 512 (i.e. a potential ground, perhaps made of copper).

The first conductive structure 202 is at one end connected to the conductive strip 204 while the other side is open as discussed in FIG. 2. Another end of the conductive strip 204 is connected to a first feed point 514 (i.e. an antenna port). A second feed point 516 is connected to the conducting plane 512, and is at the ground potential.

Figure 6:
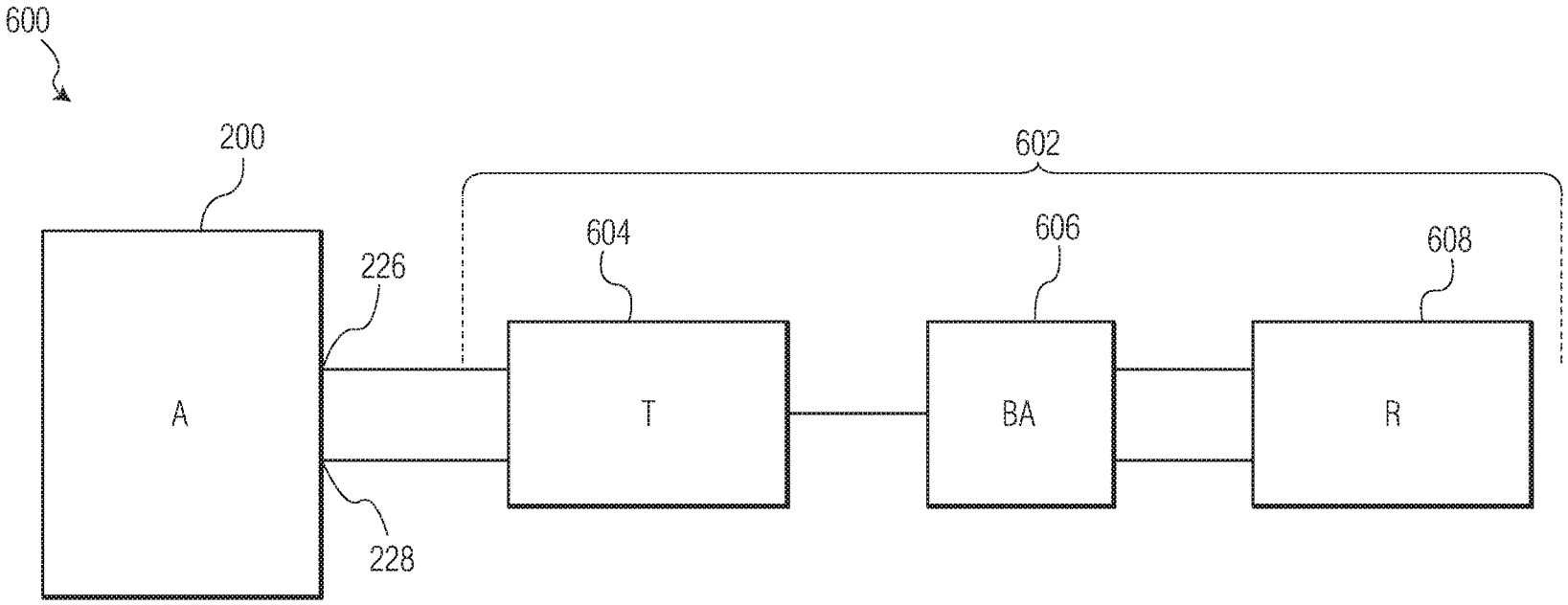
FIG. 6 is an example circuit coupled to the second wireless device antenna structure.

FIG. 6 is an example circuit 600 coupled to the second wireless device antenna structure 200. The antenna 200 feed points 226, 228 are coupled to a set of electronics 602.

The set of electronics 602 include a tuning unit 604, a balun 606, and radio electronics 608. The tuning unit 604 impedance matches the antenna 200 to an impedance of the balun 606. The balun 606 is a radio device for converting from a balanced to an unbalanced line at the RF antenna 200 frequencies. The balun 606 is further connected to the radio electronics 608. Depending on the radio electronics 608 the balun 606 may or may not be optional. Impedance matching maximizes power transfer between the radio electronics 608 and the antenna 200.

Figure 7:
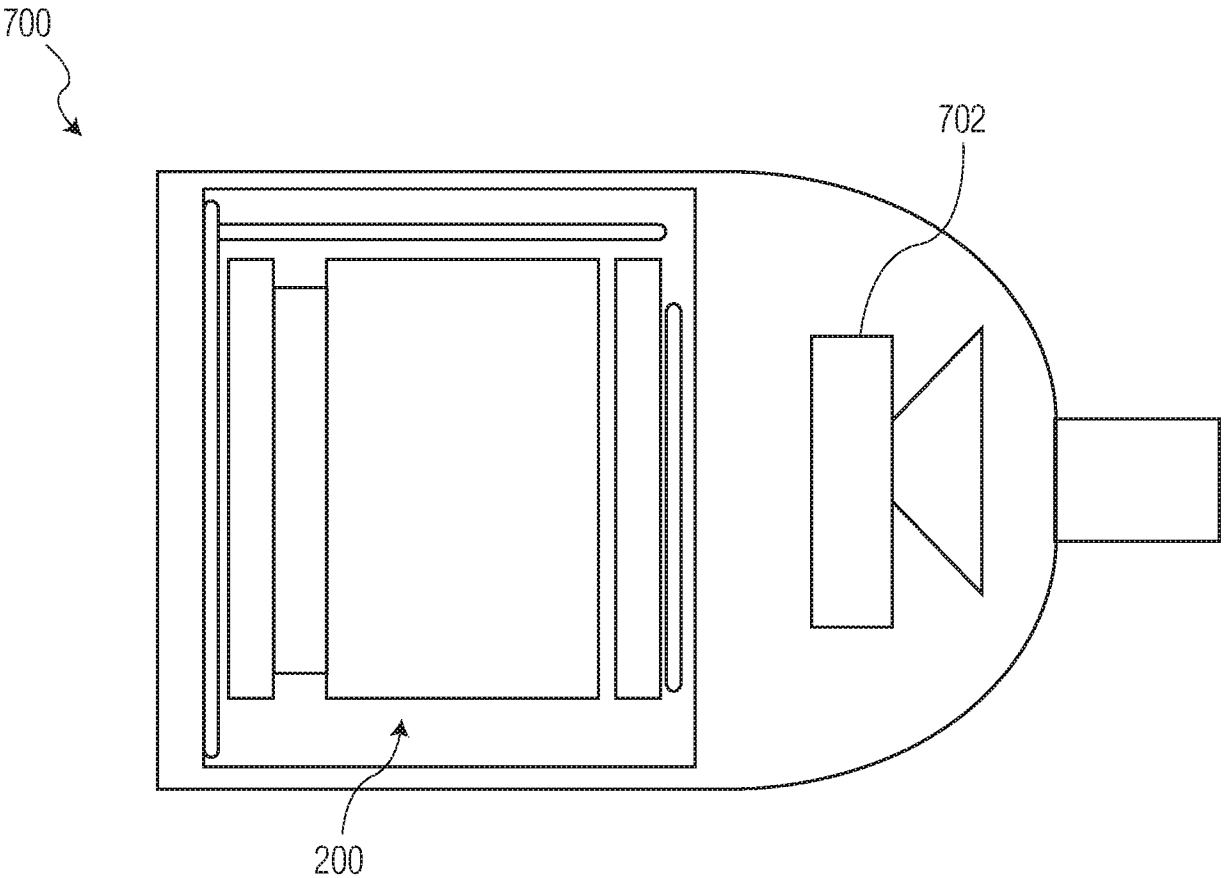
FIG. 7 is an example first earbud including the second wireless device antenna structure.

FIG. 7 is an example first earbud 700 including the second wireless device antenna structure 200. The earbud includes a loudspeaker 702 to reproduce audio signals. Radio electronics (not shown) are also included for earbud 700 functionality.

Figure 8:
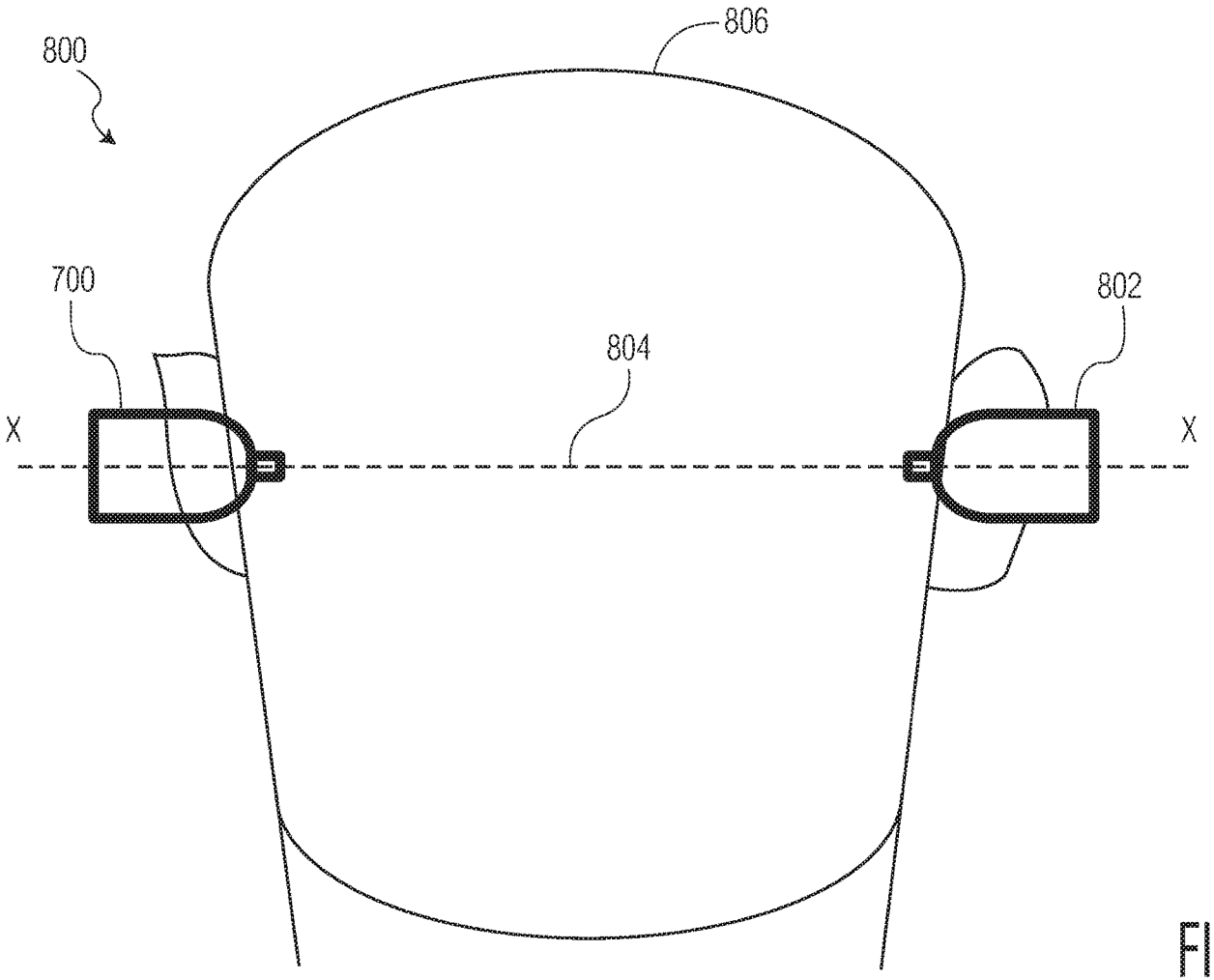
FIG. 8 is an example of the first earbud and a second earbud including the second wireless device antenna structure.

FIG. 8 is an example 800 of the first earbud 700 and a second earbud 802 including the second wireless device antenna structure 200. Example user 806 wearing positions are shown.

In one example, the antenna structure 200 in the earbuds 700, 802 is positioned according an imaginary line XX 804. This allows the antenna system 200 to generate an electric field that is normal to the skin of the user 806.

Two modes of propagation, introduced earlier, are generated. The first mode is the "on-body" mode where the electrical field vector is normal to the user's 806 skin, and where surface waves are created. In the "on-body" mode "direct" communication from ear to ear is possible.

The second mode is the "off-body" mode where the electrical field vector is parallel with the user's 806 skin, and where a far field transversal RF waves are generated and received. In the "off-body" mode communication to another device (i.e. a smartphone, another earbud, a Car2X device, etc.) that is positioned away from the user 806 occurs.

It will be readily understood that the components of the embodiments as generally described herein and illustrated in the appended figures could be arranged and designed in a wide variety of different configurations. Thus, the detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

What is claimed is:

1. An antenna, comprising:

a first conductive structure having a first end coupled to a conductive strip and a second end;

wherein the conductive strip is coupled to a first feed point;

a second conductive structure having a first portion and a second portion;

wherein the second portion is coupled to a second feed point;

wherein the second end of the first conductive structure is separated from the first portion of the second conductive structure by a gap;

wherein the first conductive structure is substantially in parallel with and has a different width than the first portion of the second conductive structure;

wherein the first conductive structure is configured to carry current in a first polarity and the first portion of the second conductive structure is configured to carry current in a second polarity opposite to the first polarity; and wherein the first and second feed points are configured to carry an RF signal.

2. The antenna of claim 1:

wherein the first conductive structure is configured to have a first current density;

wherein the first portion of the second conductive structure is configured to have a second current density; and wherein the first current density is different from the second current density.

3. The antenna of claim 2:

wherein the first current density is greater than the second current density.

4. The antenna of claim 1:

wherein the conductive strip is substantially in parallel with and has a different width than the second portion of the second conductive structure; and wherein the conductive strip is configured to carry current in a first polarity and the second portion of the second conductive structure is configured to carry current in a second polarity opposite to the first polarity.

5. The antenna of claim 1:

wherein the conductive strip is configured to have a first current density;

wherein the second portion of the second conductive structure is configured to have a second current density; and wherein the first current density is different from the second current density.

6. The antenna of claim 5:

wherein the first current density is greater than the second current density.

7. The antenna of claim 1:

wherein a total electrical length of the first conductive structure, the conductive strip, and the second conductive structure is at least ½ wavelength of the frequency received at the first and second feed points.

8. The antenna of claim 1:

wherein an electrical length of the first conductive structure added to an electrical length of the conductive strip is at least ¼ wavelength of the frequency received at the first and second feed points.

9. The antenna of claim 1:

wherein the first conductive structure and the first portion of the second conductive structure are configured to radiate a transverse RF signal; and wherein the conductive strip and the second portion of the second conductive structure are configured to radiate a surface RF signal.

10. The antenna of claim 1:

wherein the first portion of the second conductive structure is substantially perpendicular to the second portion of the second conductive structure.

11. The antenna of claim 10:

wherein the second conductive structure is a battery, the first portion is a top of the battery and the second portion is a side of the battery.

12. The antenna of claim 1:

wherein a distance between the first conductive structure and the first portion of the second conductive structure is less than quarter wavelength.

13. The antenna of claim 1:

wherein the first conductive structure has at least one of: a circular shape, a rectangular shape, or a spiral shape.

14. The antenna of claim 1:

wherein the antenna is embedded in at least one of: a wireless device, a wearable device, a hearing aid, an earbud, a smart watch, an audio device, or a wireless road traffic device.

15. The antenna of claim 1:

further comprising a first substrate and a second substrate;

wherein the first conductive structure is separated by the first substrate from the first portion of the second conductive structure;

wherein the second substrate is parallel to the second portion of the second conductive structure; and wherein the second substrate includes at least one of: a PC board, electronic components or an RF circuit.

16. The antenna of claim 1:

further comprising a conducting plane;

wherein the conducting plane is parallel to the second substrate; and wherein the second feed point is coupled to the conducting plane.

17. The antenna of claim 1:

wherein the conducting plane is coupled to a negative potential of an electronic circuit in the second substrate.

18. A wearable device, comprising:

an antenna, including, a first conductive structure having a first end coupled to a conductive strip and a second end;

wherein the conductive strip is coupled to a first feed point;

a second conductive structure having a first portion and a second portion;

wherein the second portion is coupled to a second feed point;

wherein the second end of the first conductive structure is separated from the first portion of the second conductive structure by a gap;

wherein the first conductive structure is substantially in parallel with and has a different width than the first portion of the second conductive structure;

wherein the first conductive structure is configured to carry current in a first polarity and the first portion of the second conductive structure is configured to carry current in a second polarity opposite to the first polarity; and wherein the first and second feed points are configured to carry an RF signal.

* * * * *